United States Patent [19]

Murphy

[11] 4,201,026

[45] May 6, 1980

[54] STRUCTURAL MEMBER

[75] Inventor: Wesley T. Murphy, Auburn, N.Y.

[73] Assignee: E.T.I. Corporation, Auburn, N.Y.

[21] Appl. No.: 947,826

[22] Filed: Oct. 2, 1978

[51] Int. Cl.[2] ..... E04C 3/32

[52] U.S. Cl. ..... 52/731; 52/531; 52/821

[58] Field of Search ..... 52/821, 730–732, 52/593, 594, 529–531

[56] References Cited

U.S. PATENT DOCUMENTS

| | | | |
|---|---|---|---|
| 1,241,281 | 9/1917 | Reiss | 52/731 |
| 1,508,871 | 9/1924 | Bloedow | 52/531 |
| 1,997,876 | 4/1935 | Sheldon | 52/731 |
| 2,148,434 | 2/1939 | Calkins et al. | 52/531 |
| 2,919,477 | 1/1960 | Schacht | 52/732 |
| 3,312,032 | 4/1967 | Ames | 52/580 |
| 3,332,197 | 7/1967 | Hinkle | 52/731 |
| 3,381,438 | 5/1968 | Bohnsack | 52/731 |
| 3,757,485 | 9/1973 | Vincens | 52/731 |
| 3,952,461 | 4/1976 | Kinsey | 52/731 X |
| 3,977,149 | 8/1976 | Haynes et al. | 52/731 |

*Primary Examiner*—Ernest R. Purser
*Attorney, Agent, or Firm*—Bruns and Jenney

[57] ABSTRACT

A preformed structural member that includes an elongated web having first and second flanges projecting laterally from its two longitudinal edges. Each of the flanges is of different construction, however, the flanges of two or more members can be interlocked to form either a right angle corner sections or continuous flooring or ceiling sections. Similarly, the member can be easily snapped into operative relationship with flat panels to create a self-standing sub-assembly possessing sufficient holding power to temporarily support the cojoined components until such time as they can be more securely locked together in final assembly.

6 Claims, 10 Drawing Figures

STRUCTURAL MEMBER

BACKGROUND OF THE INVENTION

This invention relates to a preformed structural member and, in particular, to a structural member that is capable of being utilized in a variety of different ways to form sections typically used in the erection of buildings.

The most pertinent art known to applicant at the time of filing this application includes the following U.S. Pat. Nos. 1,241,281 1,997,876, 2,919,477, 3,312,032, 3,332,197, 3,381,438, 3,757,485, 3,952,461, 3,977,149.

As disclosed by Hinkle in U.S. Pat. No. 3,332,197 and by Vincens in U.S. Pat. No. 3,757,485, preformed, relatively lightweight, metal structures have been used for quite some time in the building industry to form a variety of building components such as studs, beams, flooring and the like. These preformed structural members are usually profiled so that they may be slid together with other building elements to provide a sub-assembly having sufficient strength to allow it to be temporarily erected. This characteristic which allows structural members to be interlocked or snapped together with other components is sometimes referred to as "assembly holding power".

As best evidenced by Vincens in the above noted patent, most structural members that are used in the art are specially formed to carry out a single task which dictates the form or shape that the member takes. Because of the special nature of each member, a relatively large number of complex component parts are required to erect any given structure. This presents many unwanted assembly problems and raises the overall cost of the structure. By the same token, large numbers of special tools, wrenches and the like, have heretofore been required in order to erect buildings utilizing these special profiled structural members and the subassemblies so formed were difficult to move and set in place. As a consequence, it was necessary to use heavy duty equipment and specially trained workers to erect the subassemblies.

SUMMARY OF THE INVENTION

It is therefore an object of the present invention to improve preformed structural members used in the construction industry.

Another object of the present invention is to provide a single preformed structural member having a given contour which can be conveniently employed to carry out a number of different tasks in the construction of a building or the like.

Yet another object of the present invention is to reduce the cost of buildings and similar structures using preformed structural members.

A still further object of the present invention is to provide a preformed structural member that is capable of being temporarily joined to a wide range of other structural components with sufficient holding force to permit rapid and safe erection thereof.

Another object of the present invention is to provide a high-strength, multiple-purpose structural member that can be quickly interlocked with other members without the need of using special tools or highly trained workers.

These and other objects of the present invention are attained by means of a structural member having an elongated web including first and second end flanges projecting laterally from two longitudinal edges of the web to the same side thereof and which are open to the opposite side of the web. Each flange including a flat base that is parallel with the web, an inner side wall connecting the base to the web and an outer side wall that is in parallel alignment with the opposite or inner side wall. The first flange contains a foreshortened arm that depends from the top edge of its outer side wall and which is turned inwardly towards the web in co-planar alignment therewith. The base of the second flange extends outwardly beyond its outer side wall and is joined to the outer side wall by means of an oblique leg. The second flange further includes a hook-like appendage having a rail depending outwardly from the top edge of its outer side wall that is also in co-planar alignment with the web and which terminates in a lip that is turned inwardly toward the main body of the flange. In assembly, two or more structural members may be joined together to form a number of different shapes by simply interlocking the end flanges of the members together. Through use of the hooked flange, the structural member is also able to support flat wall panels in assembly thereby considerably simplifying procedures presently used in the industry.

DESCRIPTION OF THE DRAWINGS

For a better understanding of these and other objects of the invention reference is had to the following detailed description of the invention which is to be read in conjunction with the following drawings, wherein:

FIG. 6 is a perspective view of two structural members embodying the teachings of the present invention being joined together to form a flat partition suitable for use as a sub flooring or the like;

DESCRIPTION OF THE INVENTION

Figure 1:
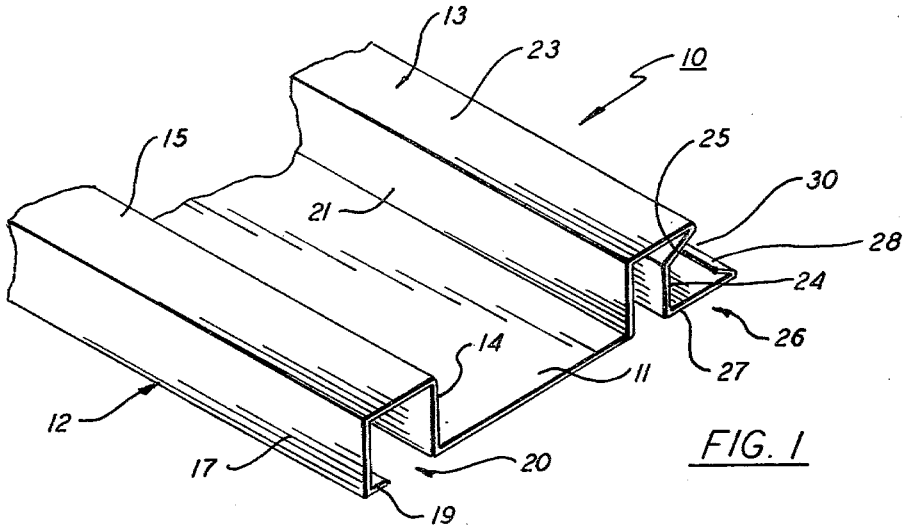
FIG. 1 is a perspective view of a structural member embodying the teachings of the present invention.

Referring initially to FIG. 1, there is shown a structural member, generally referenced 10, embodying the teachings of the present invention. As shown, the member includes an elongated planar web 11 having a first rectangular shaped flange 12 projecting laterally from one longitudinal edge thereof and a second hooked flange 13 also projecting laterally from the opposite longitudinal edge thereof. The two flanges are both offset to the same side of the web and are arranged to open in the direction of the other side of the web. Preferably the structural member is roll formed from a single sheet of metal possessing sufficient strength to allow the member to be safely used in the intended building applications while still providing sufficient resiliency to permit the member to be snapped into locking engagement with other building components in a manner which will be explained in greater detail below.

The rectangular flange 12 includes a base 15 that is parallel with the web and which is connected to one longitudinal edge thereof by means of a flat inner side wall 14. The base is also connected to a second outer side wall 17 that is in parallel alignment with the opposite side wall and whose distal edge lies in the plane of the web. A foreshortened arm 19, which is in coplanar relationship with the web, depends inwardly from the distal edge of wall 17 a predetermined distance so as to form a restricted throat at the entrance to the flange the function of which shall be explained in greater detail below.

The opposite flange 13, which is herein referred to as the hooked flange, depends laterally from the web to the same side as the previously described rectangular flange 12. The hooked flange similarly contains a flat base 23 that is parallel with the web and which is connected to the opposite longitudinal edge by a normal inner side wall 21. The base extends outwardly from the edge of the web past the margin of an outer side wall 24 which is in parallel alignment with the opposite side wall 21. The extended end of the base is joined to the outer wall of the flange by means of an oblique leg 25 which forms an acute angle with the base.

A hook-like appendage, generally referenced 26, is carried by the outer wall 24 of the flange 13. The appendage is comprised of an outwardly extended rail 27 depending from the top edge of the outer flange wall 24 and, which like the arm 19 on the rectangular flange, is in coplanar alignment with the web. The rail terminates in a lip 28 that is turned back toward the outer wall of the flange. A second restricted throat 30 is thus established between the tip of the lip and the inclined surface of the oblique leg 25.

Figure 2:
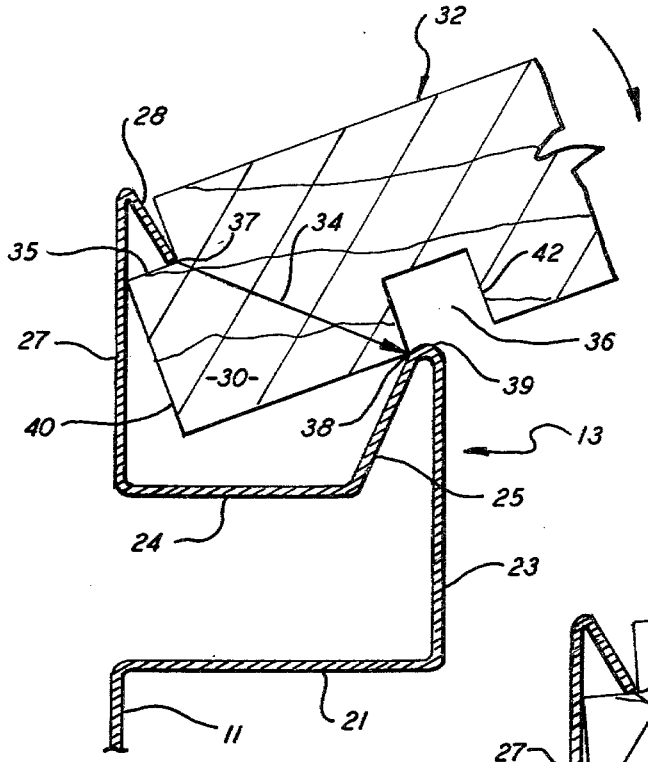
FIGS. 2-4 are enlarged views showing the steps by which the hooked flange of the member illustrated in FIG. 1 engages a wall panel to secure the panel in assembly.
Figure 3:
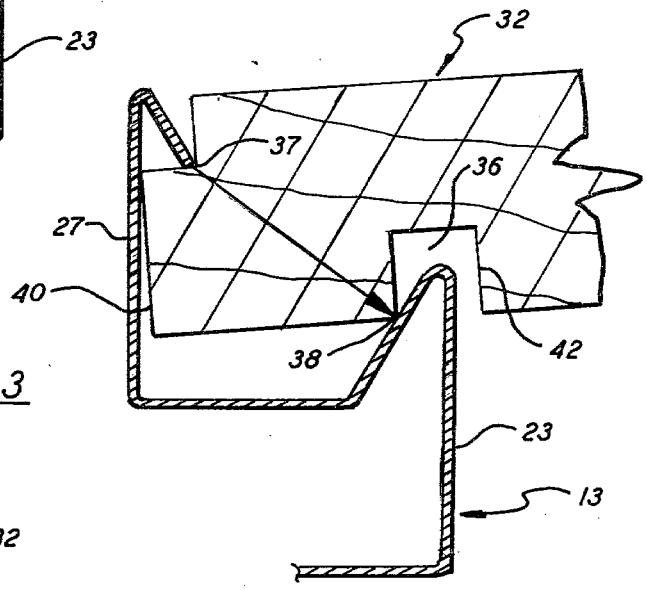
Figure 4:
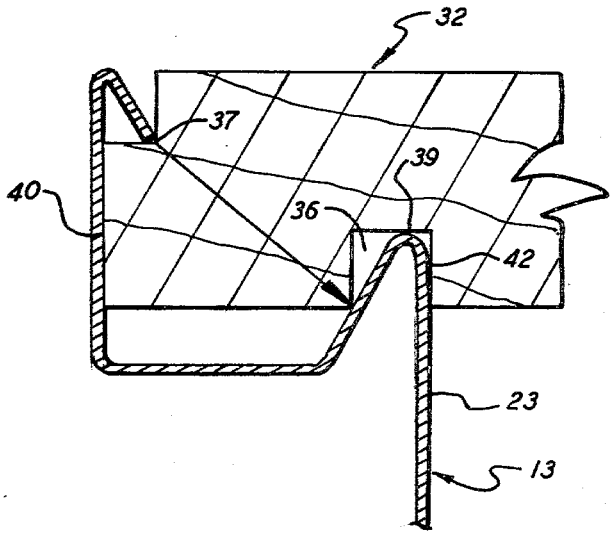

Turning now to FIGS. 2–4, a hooked flange 15 is shown being employed to secure a flat panel 32 of the type typically employed to construct walls or the like, to the structural member. In practice, the panel is precut prior to assembly to form a recessed right angle shoulder 35 along one outer edge of the panel. A parallel rectangular groove 36 is also formed in the inner surface of the panel so that the distance 34 between the inside corner 37 of the shoulder and the closest outside corner of the groove is maintained at a given dimension.

In operation, the lip 28 of the hook-like appendage 26 is initially seated against the inside corner 37 of the panel shoulder as seen in FIG. 2 and the outside corner 38 of the groove is brought into contact against the surface of oblique leg 25 by turning the panel in the direction indicated. The narrowest section of the throat 30 occurs between the tip of lip 28 and the extreme outer edge 39 of the leg 25 with the throat opening up as you move into the entrance region.

The distance 34 between the two corners of the panel is of a length whereby a continuous interference fit is maintained between the panel and the flange as corner 38 moves down leg 25. Initially, the panel will deform the flange under relatively heavy pressure as it passes into the throat region. However, continued rotation of the panel about corner 37 reduces this pressure proportionally to the distance travelled so that the corner 38 of the groove wants to walk down the surface of leg 25 deeper into the entrance region.

As best seen in FIG. 3, a point is reached where the center of rotation of the panel shifts from point 37 to point 38. At this time, the end wall 40 of the panel begins to ride up the surface of rail 27 to bring itself into abutting alignment against the inside surface of the rail. Under the biasing force exerted by the resilient flange, this latter action takes place rapidly thus causing the panel to be snapped into interlocking relationship with the structural member as viewed in FIG. 4. Here again, because of the construction of the flange, a continuous holding pressure is exerted upon the panel to hold the panel in seated alignment within the flange as shown. The width of the groove 36 is such that the inner side wall 42 of the groove rests in contact against the top surface of the base 23 when the panel is locked in position. At this time, the extreme edge 39 of the oblique leg is bottomed within the groove to prevent further movement of the panel in relation to the flange.

Figure 5:
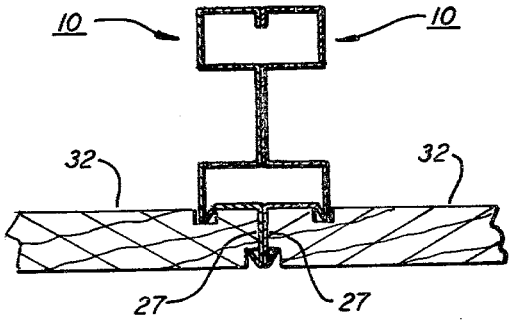
FIG. 5 is a side elevation in section showing two structural members embodying the teachings of the present invention placed in back-to-back relationship to form a wall stud and further illustrating the stud engaging two wall panels to form a continuous wall surface.

Turning now to FIG. 5, there is shown two structural members 10 that have been brought into abutting contact to form a vertical stud. In this arrangement, the rail sections of the hooked appendages are seated in back-to-back contact and two panel sections are locked to the stud to create a continuous wall section. As is well known in the building industry, the studs are typically located on predetermined centers thus enabling the panel sections to be preformed into standard size sections.

Figure 6:
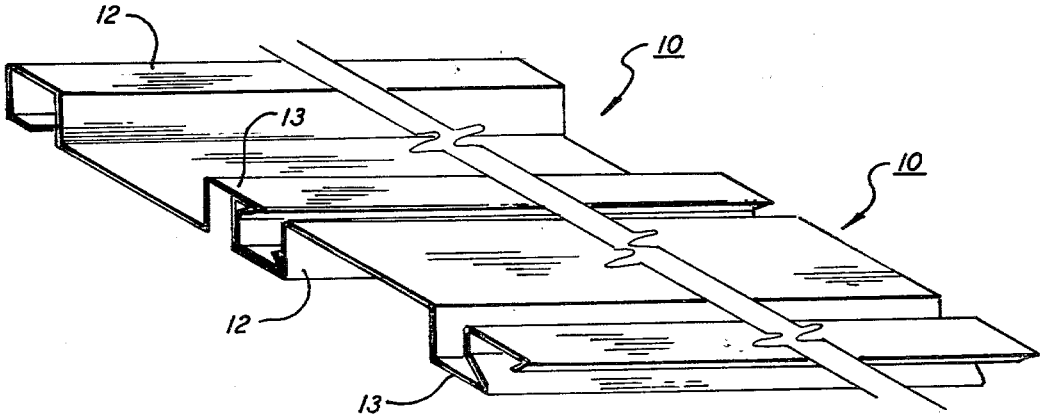
Figure 7:
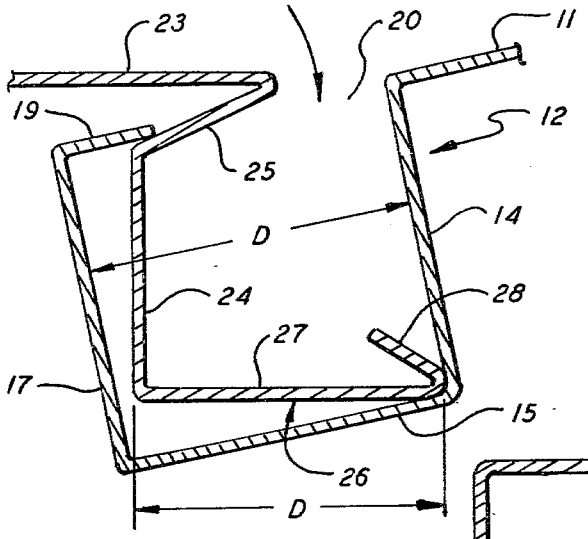
FIGS. 7 and 8 illustrate the steps in interlocking two dissimilar flanges of two structural members together whereby the interlocked members form a relatively flat partition as shown in FIG. 6.
Figure 8:
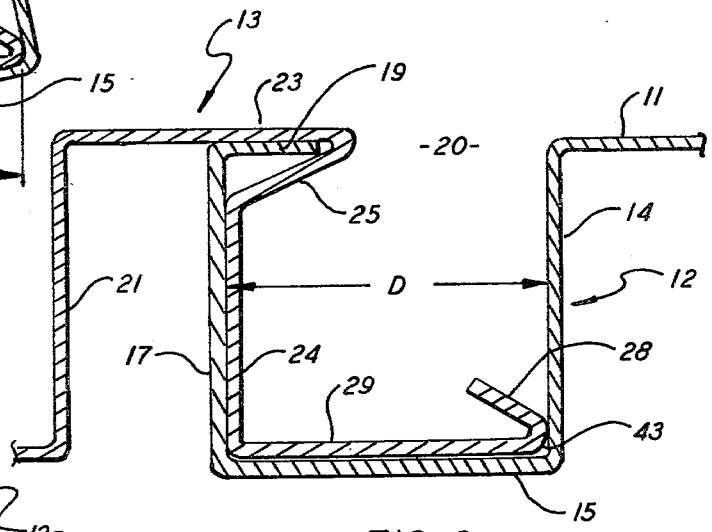

Turning now to FIG. 6, a number of panels are shown locked together in general parallel alignment to form an enlarged partition that can be used for subflooring or the like. The partition is formed as shown in FIGS. 7 and 8 by interlocking the hooked flange of one structural member into the rectangular flange of a second member. In practice, the inside width D of the rectangular flange 12, as measured between the inside surfaces of the two side walls 14 and 17, is substantially equal to the overall length of the rail 29 extending outwardly from the flange 13. As a result, the hooked appendage is capable of being received between the two side walls of the rectangular flange.

To interlock the hooked flange 13 within the rectangular flange 12, the hooked appendage 26 is passed obliquely into flange 12 through its restricted opening and the outer end 43 of the rail seated against the inner corner formed by the base and inner side wall of receiving flange 12. The hooked flange is then turned downwardly in the direction indicated until the tip of arm 19 is arrested against the inclined surface of the leg 25 as shown in FIG. 7. The geometry of the system is controlled so that a biasing pressure is exerted against the two flanges as arm 19 moves along the surface of the leg 25.

To achieve this result, the overall depth of flanges 12 and 13 are both about equal to the inside width D of the rectangular flange 12. The length of the arm 19 is held to about one third the inside width D of the flange and the leg 25 is formed at an angle of about between 15 and 25 degrees with the base of flange 13. Under these conditions, maximum biasing pressure is exerted upon the flanges when the arm 19 initially begins to move along the inclined surface of leg 25. Here again, the inclined plane of the leg serves to provide a diminishing throat to the arm as the hooked flange turns about point 43 so that the hooked flange tends to be drawn into the rectangular flange as the arm moves up the surface of the leg. Consequently, the rail 29 of flange 13 is forced into seating alignment within the base 15 of the rectangular flange 12. This, in turn, places the arm 19 against the base 23 of the hooked flange to provide stability to the two joined members.

Figure 9:
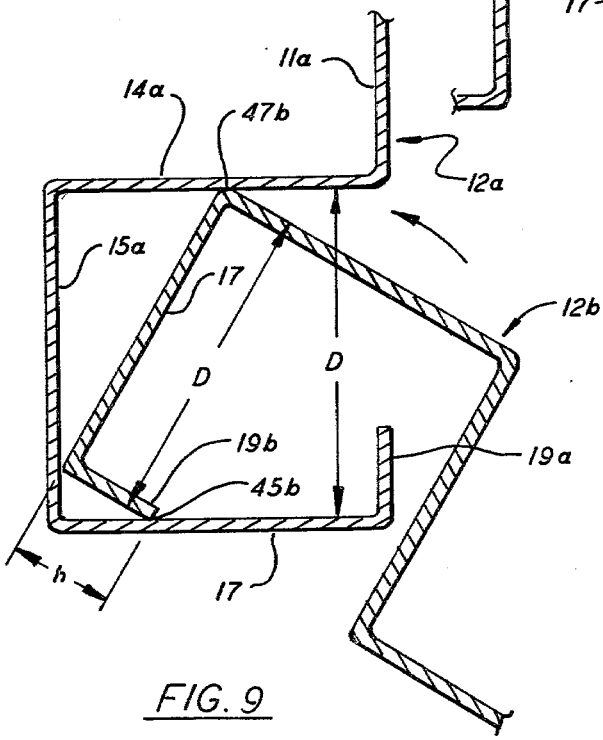
FIGS. 9 and 10 illustrate the steps of interlocking similar rectangular flanges of two structural members together whereby the two members form a right-angle corner.
Figure 10:
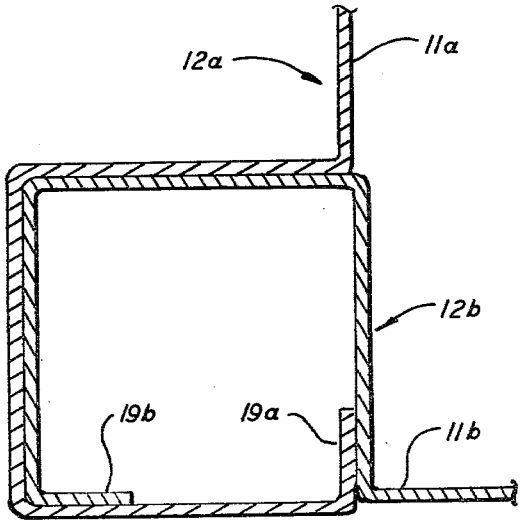

Two structural members of the present invention may also be interlocked at their rectangular flanges to form a right angle corner. As shown in FIGS. 9 and 10, this is accomplished by obliquely passing the foreshortened arm of one flange through the restricted opening of the receiving flange and then turning the two flanges into complimentary alignment one within the other.

For purposes of explanation, the component parts of the receiving flange will be designated with the letter "a" while those of the internally accepted flange will be designated with the letter "b".

As best seen in FIG. 9, the inside width D of the rectangular flange between its two side walls is substantially equal to the outside depth of the flange as measured over its base and its foreshortened arm. Accordingly, one flange can be snuggly received within the other. However, due to the foreshortened arm 19*a* and *b*, the flanges 12*a* and 12*b* can only be turned into complimentary alignment.

As illustrated, the length "h" of each arm is formed to about one third of the inside width D and, as a consequence, the arm 19*b* of the received flange 12*b* is initially arrested against the base 15*a* and the side wall 17*a* of the receiving flange 12*a*. Turning the flange 12*b* in the direction indicated (FIG. 9) causes the corner 47*b* of the received flange to move into biasing contact with the opposite side wall 14*a* of the receiving flange. Sufficient resiliency is built into the system to permit the corner 47*b* to move along the side wall of the receiving flange. With continued turning, a point is reached where the holding pressure exerted by wall 17*a* against the tip 45*b* of arm 19*b* is relieved thus allowing the arm to slide down the wall. This causes wall 17*b* of the inner flange to be rapidly pulled against the base 15*a* of the receiving flange to secure the two flanges in complimentary alignment as shown in FIG. 10.

While this invention has been described with reference to the disclosure set forth above, it is not necessarily limited to this particular embodiment and this application is intended to cover any modifications or changes as may come within the scope of the present invention.

I claim:

1. A structural member in channel-like form including an elongated web having first and second open-sided flanges depending laterally from the opposed edges thereof, said flanges each including a base that is parallel with the web and projected to one side thereof by means of a perpendicular inner side wall, and further including an outer side wall in parallel alignment with the inner side wall which terminates in the plane of the web to establish an opening that faces the opposite side of the web, said first flange being rectangular in form and having a foreshortened arm secured to the terminal end of its outer side wall which is turned inwardly to restrict the flange opening, and said second flange having a base that extends outwardly beyond its outer side wall a distance at least equal to the length of the foreshortened arm of the first flange, an inclined leg joining the extended end of the base to the outer side wall and a rail outwardly extended in the plane of the web from the terminal edge of the outer side wall, said rail having a lip on the extended end thereof that is turned back toward the inclined leg, the overall length of the rail being equal to or less than the inside width of the first flange as measured between its two side walls whereby the rail of one structural member is receivable within the rectangular first flange of another similar structural member so that the foreshortened arm of said rectangular first flange is able to be turned into the space provided between the inclined leg and the base of the rail supporting second flange thereby locking the two structural members together.

2. The structural member of claim 1 wherein the overall depth of the first and second flanges as measured over the base and the web is about equal to the inside width of the first rectangular flange.

3. The structural member of claim 1 wherein the overall length of the foreshortened arm is about one-third the inside width of the first flange.

4. A structural section including in combination a structural member having a web and an open-sided flange projecting to one side of the web, said flange containing a base that is parallel with the web, an inner side wall perpendicular with the base joining the base to one edge of the web, a parallel outer side wall that terminates in the plane of the web, an inclined leg connecting the bottom of the outer side wall with the base, said leg extending outwardly from the outer side wall, a rail lying in the plane of the web extending outwardly from the terminal edge of the outer side wall, and a lip supported upon the end of the rail that is turned back toward the inclined leg to provide an entranceway therebetween having a predetermined throat width, a panel joined to the structural member having an edge cutout that passes inwardly from the top surface and one end wall of the panel to form a right angle recess and a rectangular groove formed in the bottom of said panel, the inside corner of the recess being a distance from the closest outside corner of the groove that is substantially equal to the throat width of the entranceway contained in the structural member whereby the lip of the rail can be placed in the panel recess and the said closest outside corner of the groove moved along the surface of the inclined leg through the entranceway to position the said one end wall of the panel in the plane of the web and thus lock the panel to the structural member.

5. The structural section of claim 4 wherein the edge formed by the inclined leg and the base of the flange rests against the bottom of the groove when the panel is locked to the structural member.

6. The structural section of claim 4 wherein the throat width of the structural member is slightly smaller than the distance between the corners of the panel whereby a biasing pressure is exerted by the structural member upon the panel when the two are locked together.

* * * * *